US010588395B2

(12) United States Patent
Kiszkan

(10) Patent No.: US 10,588,395 B2
(45) Date of Patent: Mar. 17, 2020

(54) APPARATUS FOR PROPER APPLICATION OF MAKEUP AND NAIL POLISH AND METHODS THEREOF

(71) Applicant: Catherine Kiszkan, Chicago, IL (US)

(72) Inventor: Catherine Kiszkan, Chicago, IL (US)

( * ) Notice: Subject to any disclaimer, the term of this patent is extended or adjusted under 35 U.S.C. 154(b) by 0 days.

(21) Appl. No.: 15/081,446

(22) Filed: Mar. 25, 2016

(65) Prior Publication Data

US 2016/0278504 A1 Sep. 29, 2016

Related U.S. Application Data

(60) Provisional application No. 62/125,779, filed on Mar. 26, 2015.

(51) Int. Cl.
*A45D 40/30* (2006.01)
*A45D 29/00* (2006.01)

(52) U.S. Cl.
CPC ..... *A45D 40/30* (2013.01); *A45D 29/004* (2013.01)

(58) Field of Classification Search
CPC ..... A45D 40/22; A45D 40/00; A45D 2040/223–224; A45D 44/12
See application file for complete search history.

(56) References Cited

U.S. PATENT DOCUMENTS 2,563,689 A * 8/1951 Muhlhauser ..... A61F 13/105 128/846
3,261,027 A * 7/1966 Lambert ..... A45D 44/12 128/857
4,807,650 A * 2/1989 Bliss ..... A45D 40/30 132/319
5,016,658 A * 5/1991 Green ..... A45D 44/12 132/216
5,178,170 A * 1/1993 Kassai ..... A45D 40/18 132/216
8,235,060 B2 * 8/2012 Konrad ..... A45D 40/30 132/200
8,960,204 B2 * 2/2015 Samain ..... A45D 44/22 132/200
2003/0106563 A1 * 6/2003 Raisner ..... A45C 11/008 132/200
2009/0183747 A1 * 7/2009 Salicunaj ..... A45D 40/30 132/200
2010/0018542 A1 * 1/2010 Konrad ..... A45D 40/30 132/200
2010/0154813 A1 * 6/2010 Deeds ..... A45D 40/30 132/200
2010/0326462 A1 * 12/2010 Dobler ..... A45D 40/0087 132/320
2011/0088716 A1 * 4/2011 Villanueva ..... A45D 44/12 132/319
2013/0247928 A1 * 9/2013 Valucci ..... A45D 44/00 132/200

* cited by examiner

*Primary Examiner* — Rachel R Steitz
*Assistant Examiner* — Brianne E Kalach
(74) *Attorney, Agent, or Firm* — Dykema Gossett PLLC

(57) ABSTRACT

A novel application apparatus for the proper application of makeup, including mascara, eyeliner, eye glitter, costume or stage makeup, lipstick and nail polish, and other facial makeup products, along with the proper application of adhesive for false eyelashes, among other uses. The instant disclosure relates to methods for using the apparatus for applying the makeup as set forth herein, along with a novel packaging device for the application apparatus.

6 Claims, 5 Drawing Sheets

APPARATUS FOR PROPER APPLICATION OF MAKEUP AND NAIL POLISH AND METHODS THEREOF

PRIORITY STATEMENT

This application claims the benefit of U.S. Provisional Application 62/125,779 filed Mar. 26, 2015.

BACKGROUND a. Technical Field

The instant disclosure relates to a novel apparatus for the proper application of makeup, including mascara, eyeliner, eye glitter, costume or stage makeup, lipstick and nail polish, and other facial makeup products, along with the proper application of adhesive for false eyelashes, among other uses. The instant disclosure relates to methods for using the apparatus for applying the makeup as set forth herein. Also, the instant disclosure relates to a novel packaging device for the application apparatus.

b. Background Art

Applying makeup to the face is not an easy process and even with time and practice, many people find it difficult to properly apply the makeup to the face and other parts of the body. Makeup can include many different types, including mascara, eyeliner, eye glitter, lipstick and nail polish, among other types. Included in the makeup types for the instant disclosure is adhesive for false eyelashes, eye glitter and costume or stage makeup. As an example, mascara is applied to the eyelashes to make them seem more pronounced and noticeable. It can be difficult to apply mascara without getting excess mascara on the various parts of the eye, besides the eyelashes.

Further, as another example, eyeliner is properly applied onto the edges of the eyelids, which can be difficult to do evenly, especially if one does not have a steady hand, and without accidentally applying the eyeliner to other areas of the eye. All of these examples and the other applications of makeup to the face and body are learned over time and even then, are sometimes difficult to do in a manner that provides the look one desires.

Previous patents and applications have disclosed attempts to facilitate the application of makeup on the face and body. For example, U.S. Pat. No. 8,939,159 discloses a device for assisting in the application of eyeliner, in which a handle connects to a shaped member, which includes a guide portion for abutting against a user's eyelid. Users of the device may apply eyeliner by drawing an eyeliner applicator along a side of the guide portion. The device also includes a nose bridge which is situated between the guide portion and the handle, thereby allowing the device to be positioned across a user's nose when in use.

Another applicator example, Publication No. 2014/002006 A1 discloses an applicator for applying eyeliner to the eyelids, which comprises a generally flat gripping part with a non-rotating applicator part containing an application surface, which comes into contact with the skin of the eyelids in order to apply the eyeliner. The application surface has a generally convex shape and the gripping part having a greater or equal apparent height then the applicator part.

The device disclosed in U.S. Pat. No. 3,485,251 is used to defines an eye line having a regular contour using a guide strip which may be applied on the eyelids and which will mask the portion of the eyelid above the eye line. The guide strip comprises a sheet of flexible material having a curved edge to define the shape of the eye line. On one side of the sheet there is an adhesive for holding the guide strip onto the eyelid, and the guide strip is preferably made of a plastic material and usually has the general shape of a wing.

Also, the device disclosed in U.S. Pat. No. 6,619,298 is for making up, or for a care treatment, of the user's lips, which includes a support, at least a portion of which can be impregnated by a liquid-to-pasty product. The support has a flattened shape and has at least one application surface capable of coming into contact with the user's lips. The portion impregnated with the product is capable of elastic deformation by compression of the surfaces by the lips and of assuming their shape, so that a transfer of the product to the lips is effected during the compression of the support between the user's lips.

Also, U.S. Pat. No. 8,141,564 discloses a lightweight, portable article for precise application of makeup, which is placed upon a user's eyelid skin, preferably the bottom eyelid skin, adjacent to the eyelashes. With this placement, a user can readily apply mascara or eyeliner without contacting the delicate eyelid skin. The article has a handle portion and an arcuate top portion, which includes an applicator rim with rounded lateral edges and an arced central section, both of which are covered with a rubber guard. The rubber guard contiguously traverses the entire surface area of the applicator rim, resulting in a device yielding a high degree of safety. The article is formed of a smooth polymeric or metal material, and is compact, easily cleaned and enables application of mascara in a safe, hygienic manner.

None of the references described above disclose a disposable face and eye makeup application tool, which prevents unwanted residual fallout of makeup onto areas of the face where the makeup is not desired. Further, none of the references disclose a paper-based, lightweight applicator that is configured to a shape and flexibility so that it can be held over or under the eye on the eyelid during makeup application, and can be used to apply adhesive for false eyelashes. Also, none of the references disclose a disposable applicator that can be likewise used to properly apply lipstick or nail polish without leaving traces of lipstick or nail polish on the face or fingers, respectively. Further, none of the references disclose a packaging configuration for the applicator apparatus so that one or more of the applicators can be placed into the package for easy storage and retrieval, and which can be carried around in one's purse or pocket.

As such there is a need for an applicator apparatus that is disposable and can be used to assist in the proper application of makeup, including mascara, eyeliner, eye glitter, costume or stage makeup, lipstick and nail polish, and other facial makeup products, along with assisting in the proper application of adhesive for false eyelashes, among other uses. There is also a need for a novel packaging device for holding and securing the application apparatus.

The foregoing discussion is intended only to illustrate the present field and should not be taken as a disavowal of claim scope.

BRIEF SUMMARY

An improved makeup application apparatus is disclosed herein. The novel apparatus is used for the proper application of makeup onto the face or body without inadvertently applying makeup to areas in which no makeup is intended. Makeup is broad enough to include mascara, eyeliner, eye glitter, costume or stage makeup, lipstick nail polish, and other facial makeup products. Makeup also can pertain to adhesive for false eyelashes and other uses.

One objective of the instant disclosure is to provide a disposable face and eye makeup application tool, configured to prevents unwanted residual fallout of makeup onto areas of the face where the makeup is not desired.

Another objective of the instant disclosure is to provide a paper-based, lightweight applicator that is configured to a shape and flexibility to be flexed as needed and held over or under the eye or on the eyelid during makeup application, and during the application of adhesive for false eyelashes. The applicator can also be used to shape one's eyebrow and to assist and shield when removing hair manually or electronically.

Yet another objective of the instant invention, is to use the novel application apparatus to properly apply lipstick or nail polish without leaving traces of lipstick or nail polish on the face or fingers, respectively.

Yet another objective of the instant invention is to provide a package device for easy storage and retrieval of the application apparatus, such that 20 or more of the applicators can be placed into the package and easily carried around in one's purse or pocket.

Other objects and advantages of the present disclosure will become apparent to one having ordinary skill in the art after reading the specification in light of the drawing figures, however, the spirit and scope of the present invention should not be limited to the description of the embodiments contained herein.

BRIEF DESCRIPTION OF THE DRAWINGS

FIG. 1A and FIG. 1B 1 illustrate an exemplary embodiment of the application apparatus in accordance with the instant invention.

DETAILED DESCRIPTION

Figure 1A:
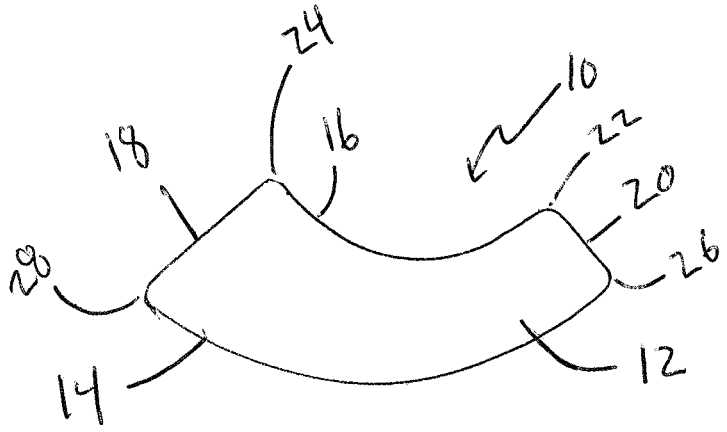

Referring to the drawings, wherein like reference numerals refer to the same or similar features in the various views, FIG. 1A shows an exemplary embodiment of the instant invention, a disposable face and eye makeup application apparatus, applicator or tool 10, configured to prevents unwanted residual fallout of makeup onto areas of the face where the makeup is not desired. Here, makeup can include mascara, eyeliner, eye glitter, costume or stage makeup, lipstick and nail polish, or other types of makeup that gets applies to the face or skin. Makeup can also include adhesive, such as that used to apply false eyelashes to the eye.

The application apparatus, applicator or tool 10 is paper-based, lightweight applicator 12 that is configured and shaped for flexibility, so that it can be flexed as needed and held over or under the eye or on the eyelid (see FIGS. 2 and 3) during makeup application, and during the application of adhesive for false eyelashes.

In the preferred embodiment, the application tool 10 is created using a shaped die to cut the shape described below, from flat, heavy weight paper with stiffness similar to an index card of 65 lb. Material.

Although the preferred embodiment of the application tool 10 is paper-based, the tool 10 can be made from cardboard, plastic or metal, as long as the tool 10 is pliable enough that it can be flexed or deformed to cover the portion of the eye or skin that makeup is not intended to be applied.

The application tool 10 is also shaped and configured to assist in the proper application of lipstick to the lips (see FIG. 4), or to assist in the proper application of nail polish to a fingernail (see FIG. 5), without leaving traces of lipstick or nail polish on the face or fingers, respectively. The tool 10 has an outer edge 14, an inner edge 16, a first side 18 and a second side 20. Each of the edges 14, 16 and sides 18, 20 can be used for different applications of makeup, lipstick, adhesive, etc.

In the preferred embodiment, the inner edge 16 is a symmetrical 90 degree arc about one inch from center at a first corner 22, and at a second corner 24. As such, the first side 18 and the second side 20 are perpendicular to each other if their sides were extended (about an inch towards each other) to the center of the arc.

The outer edge comprises an asymmetrical radius with a third corner 26 about 1.5 inches from the center, and a fourth corner 28 about 1.875 inches from the center of the arc. As such, the first side 18 is about 0.875 inches long and the second side 20 is about 0.5 inches long. Each of the four corners 22, 24, 26, 28 are rounded in the preferred embodiment to avoid accidental poking of the tool 10 into the eye or skin.

Figure 1B:
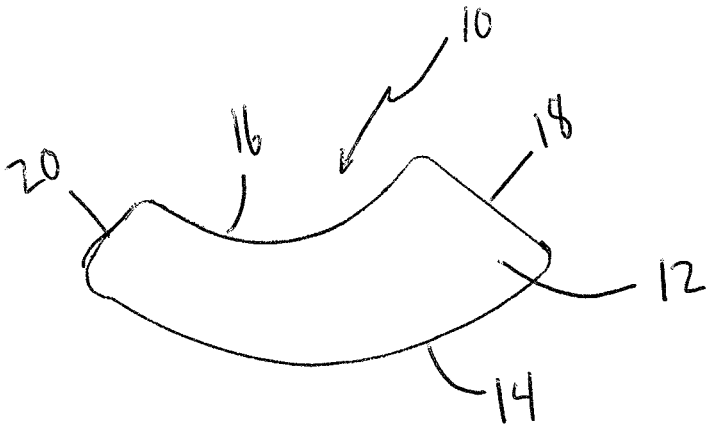

FIG. 1B shows the applicator tool 10 placed on its reversed side for use on the user's other eye. Both sides of the tool 10 can be used in the proper application of makeup, lipstick adhesive, etc. Although, there can be other dimensions that fall under the scope of the instant invention, the preferred embodiment provides dimensions that relate to the dimensions of the human face, eye and nails to allow for the tool 10 to assist in the application of makeup, lipstick and adhesive, as described herein.

Figure 2:
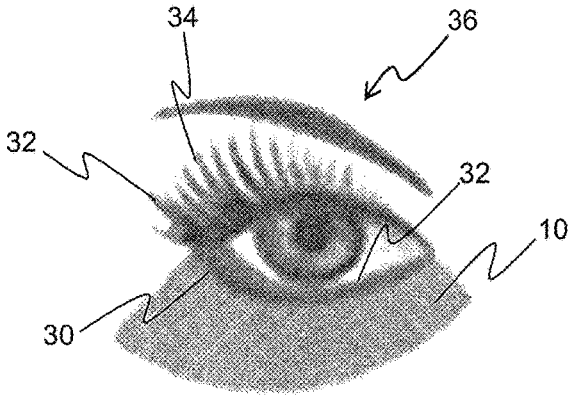
FIG. 2 illustrates an exemplary embodiment of the application apparatus in use in accordance with the instant invention.
Figure 3:
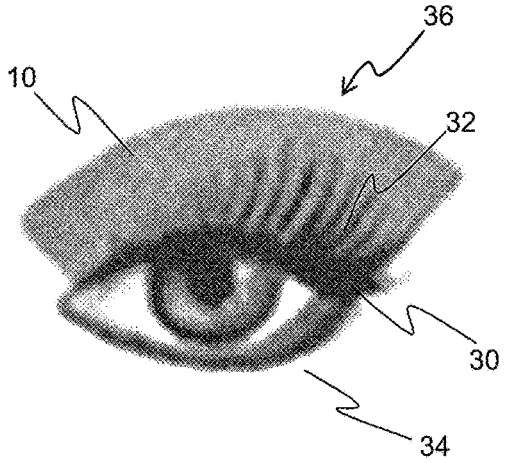
FIG. 3 illustrates an exemplary embodiment of the application apparatus in use in accordance with the instant invention.

FIGS. 2 and 3 show the application tool 10 in use to assist in the application of mascara 30 to the eyelashes 32 surrounding the eye 36 and to prevent the mascara 30 from inadvertent application around those areas 34 of the eye 36 in which it is not desired.

The user places the application tool 10 against the areas 34 of the eye 36 in which mascara 30 is not desired, with the inner edge 16 being placed closer to the actual eye 36 and the outer edge 14 being placed further away from the eye 36. The user then applies mascara 30 to the eyelashes 32 where it is desired. To the extent necessary, the application tool 10 can be flexed, bent or deformed to better contact the area 34 of the eye 36. Also, as described above, the application tool 10 can be used from either side depending on which part of the eye, in this case, mascara is to be applied.

Figure 4:
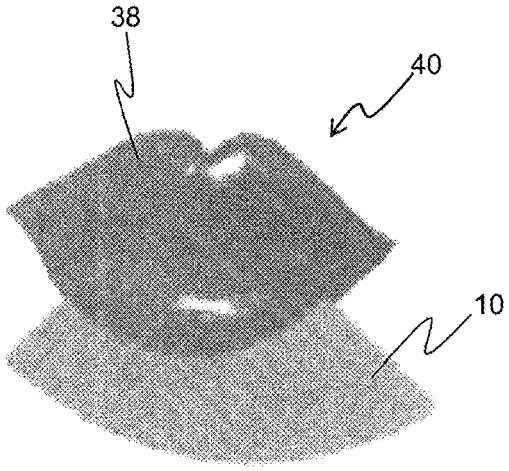
FIG. 4 illustrates an exemplary embodiment of the application apparatus in use in accordance with the instant invention.

As understood by one having ordinary skill in the art, the application tool 10 can be used as a masking tool when applying all makeup, along with lipstick and nail polish. FIG. 4 shows the application tool 10 used to properly apply lipstick 38 to the lips 40, and to avoid lipstick from being applied to an area (blocked from view by the tool 10) where lipstick 38 is not desired. Again, the user places the application tool 10 against the skin below the lips 40, with the inner edge 16 closer to the lips 40 and the outer edge 14 further away from the lips 40. The user applies the lipstick 38 and thereby avoids applying lipstick 38 onto the face below the lips 40.

Figure 5:
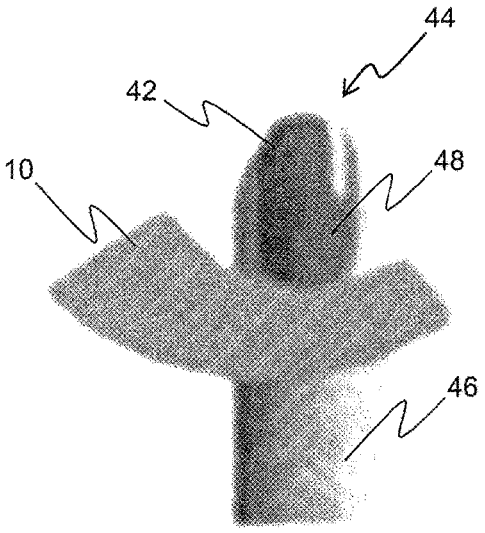
FIG. 5 illustrates an exemplary embodiment of the application apparatus in use in accordance with the instant invention.

FIG. 5 shows the application tool 10 in use to properly apply nail polish 42 to a fingernail 44 in a finger 46. The application tool 10 can be used to avoid the inadvertent application of nail polish 42 to an area (again blocked from view by the tool 10) where nail polish 42 is not desired. The user places the application tool 10 against the cuticle 48 below the nail 44, with the inner edge 16 closer to the bottom of the fingernail 44 and the outer edge 14 further away from the bottom of the fingernail 44. The user then applies nail polish 42 and avoids applying nail polish 42 onto the finger below the nail 44.

The application tool 10 can be used in numerous situations to mask a portion of skin from accidentally receiving makeup. As some additional examples, the tool can be used to shape one's eyebrow, or to be used as a guide or shield for the application of eye shadow, or costume or stage makeup, and even for "cat eye" or glitter applications, reducing any spillover. The tool 10 can also be used as a palette for mixing colors or media prior to applying to the face.

Additionally, the first side 18 can be used to apply adhesive to the eye for attaching false eyelashes. The adhesive is first placed onto the application tool 10 near the first side 18 and then the first side 18 is held at the edge between the upper eyelid and natural lashes, so that the false eyelashes can be placed and secured on the eyelid directly above the application tool 10. Using this process will ensure that the tool 10 stays above the natural lashes and keeps the adhesive from making contact with the natural lashes.

Yet another objective of the instant invention is to provide a packaging device 50 for easy storage and retrieval of the application tool 10, such that one or more application tools 10 can be securely placed into the packaging device 50 and easily carried around in one's purse or pocket. In the preferred embodiment, the packaging device 50 can hold 20 application tools 10 for easy access if needed when one is travelling or away from the home.

Figure 6:
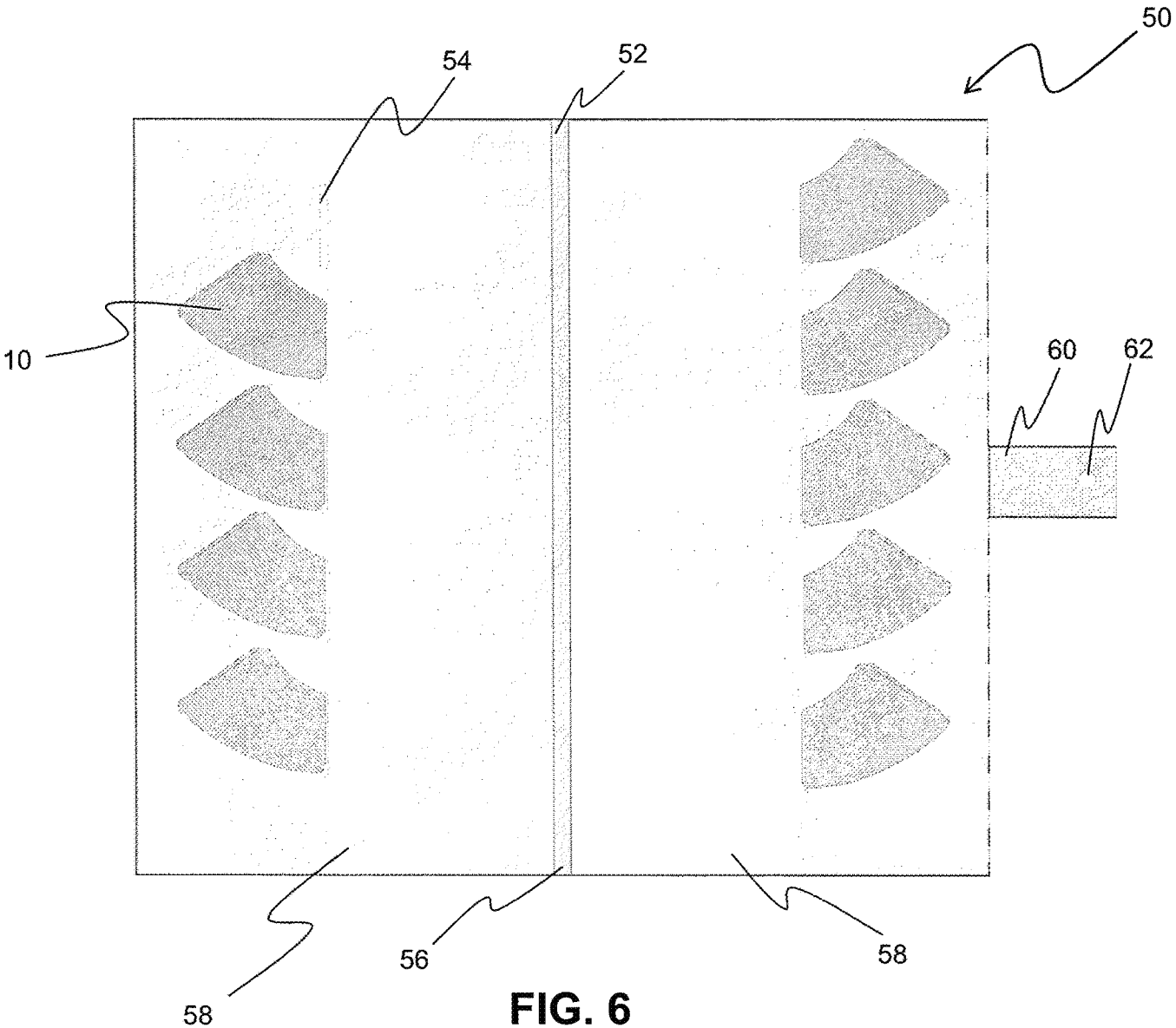
FIG. 6 illustrates an exemplary embodiment of the application apparatus packaging in accordance with the instant invention.

FIG. 6 shows an opened view of an exemplary packaging device 50, with the application tools 10 securely inserted and being held in the device 50. The preferred embodiment of the packaging device 50 is about 6 inches high by about 7 inches wide, and is configured to be fold in half with at a crease 52 at about 3.5 inches from the ends. The packaging device also has 10 openings 54, five on each side of the crease 52. The openings are about 0.6 inches long by about 0.25 inches wide and have curved ends, and are configured to accept and securely hold the application tools 10.

The packaging device 50 comprises a sleeve made up of a first layer 56 that extends the entire (outside) length of the packaging device (partially shown in FIGS. 7 and 8, when closed) and a second layer 58 on both sides of the crease 52 The openings 54 are only through the second layer 58, and do not extend all the way through the first layer 56 of the packaging device 50. This configuration provides a sleeve or envelope with the openings 54 for the application tool 10 to be inserted and securely held. As such, the second side 20 of each application tool 10 can be placed into an opening 54 and with the second side providing the back of the sleeve. In the preferred embodiment, two application tools 10 are inserted into each opening, thereby allowing 20 application tools 10 to be held in each packaging device 50.

The packaging device 50 further comprises flap 60 that can be a part of the first layer 56 and that extends out from the second layer 58. The flap 60 contains a first attachment device 62, which can be VELCRO, a snap, a button, or any other device that can be attached to a second attachment device 64 (shown in FIG. 7).

Figure 7:
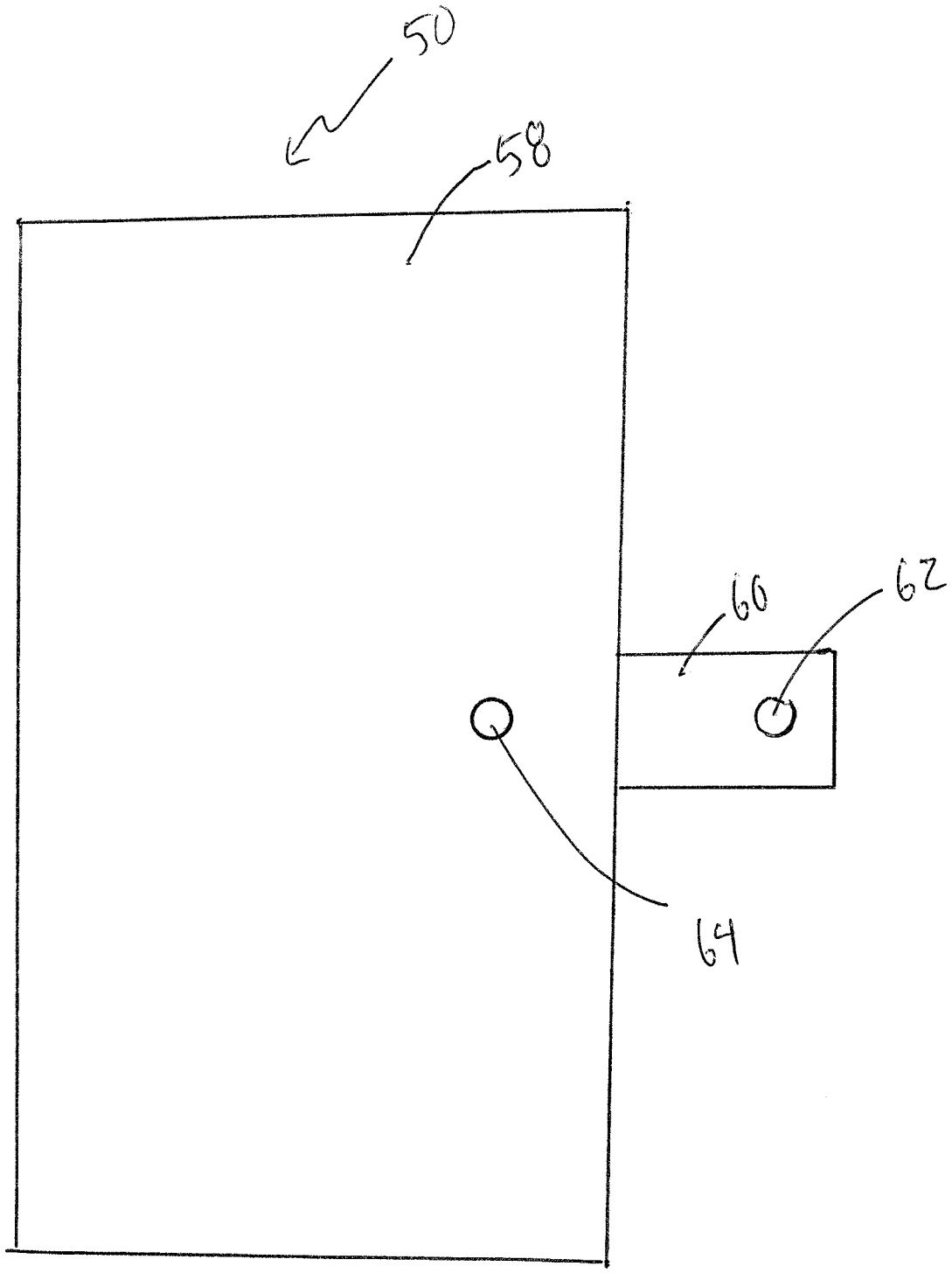
FIG. 7 illustrates an exemplary embodiment of the application apparatus packaging in accordance with the instant invention.

To protect the application tools 10 in the packaging device 50, the packaging device is folded in half at the crease 52. FIG. 7 shows the packaging device 50 folded in half with the flap 60 still out to the right. The second layer or the cover 58 of the packaging device 50 contains the second attachment device 64, which will accept the first attachment device 62 and keep the packaging device 50 closed in half, thereby protecting the application tools 10 inside the packaging device 50.

Figure 8:
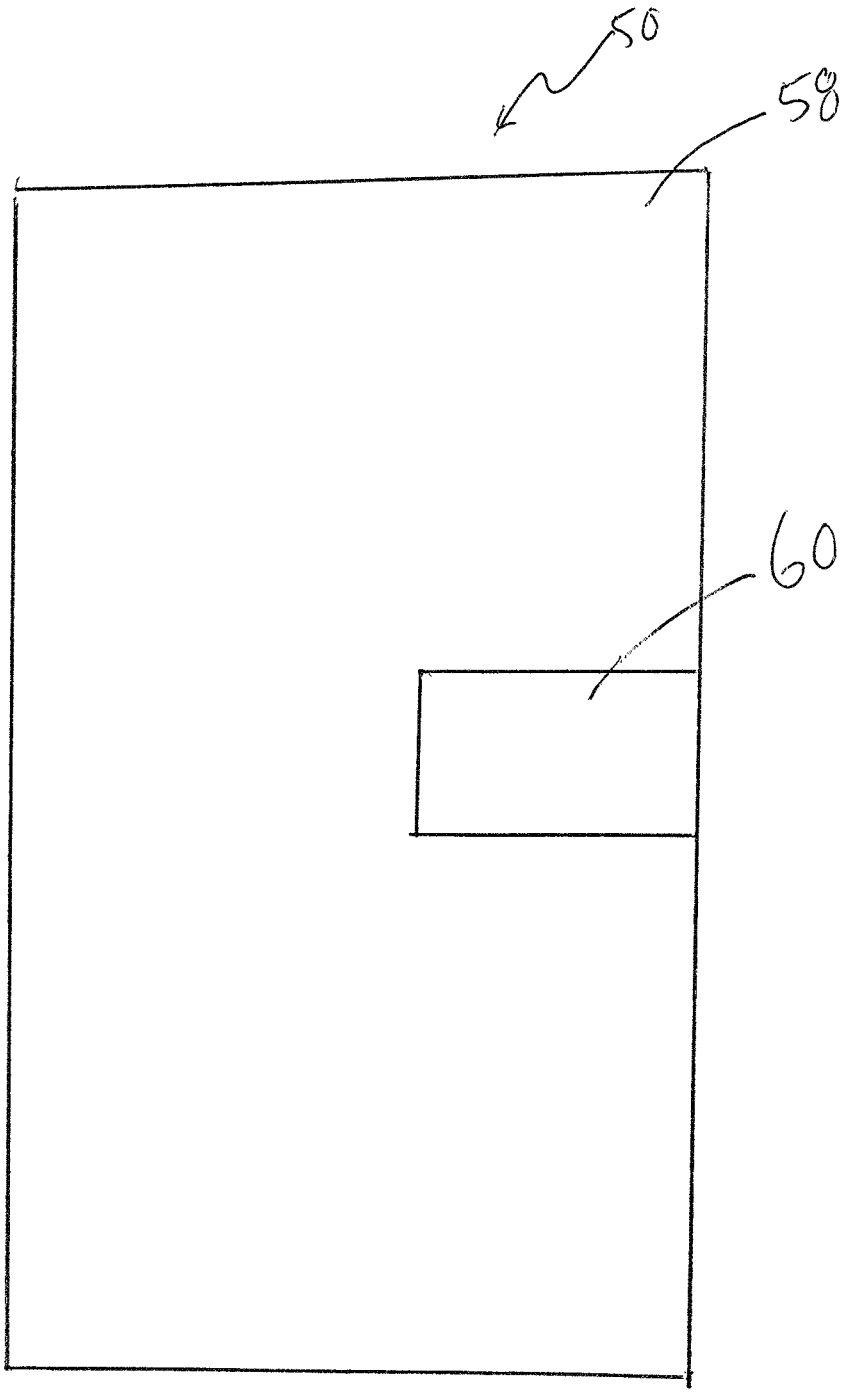
FIG. 8 illustrates an exemplary embodiment of the application apparatus packaging in accordance with the instant invention.

FIG. 8 shows the packaging device 50 after the flap 60 has been located into position and the first attachment device 62 has been attached to the second attachment device 64. For example, if both first and second attachment devices 62, 64 are VELCRO hooks and loops, then they will attach and hold the packaging device 50 closed. Once closed, the packaging device 50 is about 6 inches high, about 3.5 inches wide, and about 0.125 inches thick, which will easily fit into a purse or pocket for travel purposes.

It should be noted that, although the apparatus and methods of this disclosure have been described with respect to certain preferred and alternative embodiments, and that specific details are set forth herein to provide a thorough understanding of the overall structure, function, manufacture, and use of the embodiments, it should be understood by those skilled in the art, however, that the embodiments may be practiced without such specific details.

In other instances, well-known operations, components, and elements have not been described in specific detail so as not to obscure the embodiments described in the specification. Those of ordinary skill in the art will understand that the embodiments described and illustrated herein are non-limiting examples, and thus it can be appreciated that the specific structural and functional details disclosed herein may be representative and do not necessarily limit the scope of the embodiments, the scope of which is defined solely by the appended claims.

Reference throughout the specification to "various embodiments," "some embodiments" "one embodiment," or "an embodiment", or the like, means that a particular feature, structure, or characteristic described in connection with the embodiment is included in at least one embodiment. Thus, appearances of the phrases "in various embodiments," "in some embodiments," "in one embodiment," or "in an embodiment", or the like, in places throughout the specification are not necessarily all referring to the same embodiment. Furthermore, the particular features, structures, or characteristics may be combined in any suitable manner in one or more embodiments. Thus, the particular features, structures, or characteristics illustrated or described in connection with one embodiment may be combined, in whole or in part, with the features structures, or characteristics of one or more other embodiments without limitation given that such combination is not illogical or non-functional.

Although numerous embodiments of this invention have been described above with a certain degree of particularity, those skilled in the art could make numerous alterations to the disclosed embodiments without departing from the spirit or scope of this disclosure. All directional references (e.g., plus, minus, upper, lower, upward, downward, left, right, leftward, rightward, top, bottom, above, below, vertical, horizontal, clockwise, and counterclockwise) are only used for identification purposes to aid the reader's understanding of the present disclosure, and do not create limitations, particularly as to the position, orientation, or use of the any aspect of the disclosure. As used herein, the phrased "configured to," "configured for," and similar phrases indicate that the subject device, apparatus, or system is designed and/or constructed (e.g., through appropriate hardware, software, and/or components) to fulfill one or more specific object purposes, not that the subject device, apparatus, or system is merely capable of performing the object purpose.

Joinder references (e.g., attached, coupled, connected, and the like) are to be construed broadly and may include intermediate members between a connection of elements and relative movement between elements. As such, joinder references do not necessarily infer that two elements are directly connected and in fixed relation to each other. It is intended that all matter contained in the above description or shown in the accompanying drawings shall be interpreted as illustrative only and not limiting. Changes in detail or structure may be made without departing from the spirit of the invention as defined in the appended claims.

Any patent, publication, or other disclosure material, in whole or in part, that is said to be incorporated by reference herein is incorporated herein only to the extent that the incorporated materials does not conflict with existing definitions, statements, or other disclosure material set forth in this disclosure. As such, and to the extent necessary, the disclosure as explicitly set forth herein supersedes any conflicting material incorporated herein by reference. Any material, or portion thereof, that is said to be incorporated by reference herein, but which conflicts with existing definitions, statements, or other disclosure material set forth herein will only be incorporated to the extent that no conflict arises between that incorporated material and the existing disclosure material.

What is claimed is:

1. A method for masking and guiding the application of cosmetics on the face and body using a flexible, flat, disposable, and thin applicator tool, the applicator tool having four rounded corners and a first surface and a second surface opposite the first surface, the applicator tool further comprising:

a first edge configured in an asymmetric convex arc from a first end of the first edge to a second end of the first edge, wherein the asymmetric convex arc begins at the first end of the first edge and terminates at the second end of the first edge;

a second edge opposite the first edge and configured in a symmetric 90 degree concave arc from a first end of the second edge to a second end of the second edge, wherein the symmetric 90 degree concave arc begins at the first end of the second edge and terminates at the second end of the second edge;

a third edge extending between the first end of the first edge and the first end of the second edge, wherein the third edge begins at the first end of the second edge and terminates at the first end of the first edge; and a fourth edge perpendicular to the third edge and having a length less than the length of the third edge, the fourth edge extending between the second end of the first edge and the second end of the second edge, wherein the fourth edge begins at the second end of the second edge and terminates at the second end of the first edge;

wherein the method comprises:

placing the second edge of the applicator tool under a first eye with the first surface against the skin, and preventing an application of cosmetics to an area of skin under the first eye;

placing the second edge under a second eye with the second surface against the skin and preventing an application of cosmetics to an area of skin under the second eye; and placing the second edge under a bottom lip and preventing the application of cosmetics to an area of skin under the bottom lip.

2. The method of claim 1 wherein the method further comprises:

placing the second edge of the applicator tool above the first eye with the second surface against the skin and preventing an application of cosmetics to an area of skin above the first eye; and placing the second edge of the applicator tool above the second eye with the first surface against the skin and preventing an application of cosmetics to an area of skin above the second eye.

3. The method of claim 1 wherein the method further comprises placing the first edge under a first eyebrow with the first surface against the skin and preventing an application of cosmetics to an area of skin under the first eyebrow.

4. The method of claim 3 wherein the method further comprises placing the first edge under a second eyebrow with the second surface against the skin and preventing an application of cosmetics to an area of skin under the second eyebrow.

5. A method for masking and guiding the application of cosmetics on the face and body using a flexible, flat, disposable, and thin applicator tool, the applicator tool having four rounded corners and a first surface and a second surface opposite the first surface, the applicator tool further comprising:

a first edge configured in an asymmetric convex arc from a first end of the first edge to a second end of the first edge, wherein the asymmetric convex arc begins at the first end of the first edge and terminates at the second end of the first edge;

a second edge opposite the first edge and configured in a symmetric 90 degree concave arc from a first end of the second edge to a second end of the second edge, wherein the symmetric 90 degree concave arc begins at the first end of the second edge and terminates at the second end of the second edge;

a third edge extending between the first end of the first edge and the first end of the second edge, wherein the third edge begins at the first end of the second edge and terminates at the first end of the first edge; and a fourth edge perpendicular to the third edge and having a length less than the length of the third edge, the fourth edge extending between the second end of the first edge and the second end of the second edge, wherein the fourth edge begins at the second end of the second edge and terminates at the second end of the first edge;

wherein the method comprises:

placing the second edge of the applicator tool under a first eye with the first surface against the skin, and preventing an application of cosmetics to an area of skin under the first eye;

placing the second edge under a second eye with the second surface against the skin and preventing an application of cosmetics to an area of skin under the second eye; and placing the second edge on an area of skin below a fingernail and preventing the application of nail polish to the area of skin under the fingernail.

6. A method for masking and guiding the application of cosmetics on the face and body using a flexible, flat, disposable, and thin applicator tool, the applicator tool having four rounded corners and a first surface and a second surface opposite the first surface, the applicator tool further comprising:

a first edge configured in an asymmetric convex arc from a first end of the first edge to a second end of the first edge, wherein the asymmetric convex arc begins at the first end of the first edge and terminates at the second end of the first edge;

a second edge opposite the first edge and configured in a symmetric 90 degree concave arc from a first end of the second edge to a second end of the second edge, wherein the symmetric 90 degree concave arc begins at the first end of the second edge and terminates at the second end of the second edge;

a third edge extending between the first end of the first edge and the first end of the second edge, wherein the third edge begins at the first end of the second edge and terminates at the first end of the first edge; and a fourth edge perpendicular to the third edge and having a length less than the length of the third edge, the fourth edge extending between the second end of the first edge and the second end of the second edge, wherein the fourth edge begins at the second end of the second edge and terminates at the second end of the first edge;

wherein the method comprises:

placing the second edge of the applicator tool under a first eye with the first surface against the skin, and preventing an application of cosmetics to an area of skin under the first eye;

placing the second edge under a second eye with the second surface against the skin and preventing an application of cosmetics to an area of skin under the second eye;

applying a false eyelash adhesive onto the third edge of the applicator tool; and placing the third edge between an upper eyelid and a natural eyelash to transfer the adhesive to the skin and prevent the adhesive from being applied to the natural eyelash.

* * * * *